United States Patent [19]

Thomas, Jr.

[11] 4,392,774

[45] Jul. 12, 1983

[54] CLAM BUCKET ATTACHMENT

[76] Inventor: Dolphus W. Thomas, Jr., Rte. 1, Box 637, Bastrop, La. 71220

[21] Appl. No.: 308,400

[22] Filed: Oct. 5, 1981

[51] Int. Cl.[3] ..... B66C 3/06; E02F 3/44

[52] U.S. Cl. ..... 414/726; 414/734; 414/735; 414/722; 294/70; 294/111; 37/117.5

[58] Field of Search ..... 414/724, 734, 687, 694, 414/722, 723, 726, 735; 37/117.5; 294/70, 111, 112

[56] References Cited

U.S. PATENT DOCUMENTS

| | | | |
|---|---|---|---|
| 2,486,479 | 11/1949 | Kennedy | 294/112 X |
| 3,517,960 | 6/1970 | Mork et al. | 294/70 |
| 3,920,137 | 11/1975 | McCain | 294/70 X |
| 4,257,731 | 3/1981 | Beaver | 294/70 X |

FOREIGN PATENT DOCUMENTS

| | | | |
|---|---|---|---|
| 1121294 | 7/1956 | France | 37/117.5 |

*Primary Examiner*—Robert J. Spar
*Assistant Examiner*—Terrance L. Siemens

[57] ABSTRACT

A clam bucket attachment designed to cooperate with the crowd and the bucket curl or crowd hydraulic cylinder of a conventional backhoe, which attachment includes a bucket support pivotally and rotatably carried by the backhoe crowd and having a cable which operates to open and close a clam bucket suspended from the bucket support. A cable boom is removably, but rigidly attached to the crowd, and includes a forward and rear sheave which receive the cable, one end of which is connected to the crowd hydraulic cylinder, and the opposite end to the clam bucket. The clam bucket is opened and closed by extending and retracting the crowd hydraulic cylinder and is raised and lowered by operation of the backhoe crowd and boom, in conventional fashion.

8 Claims, 6 Drawing Figures

FIG. 1
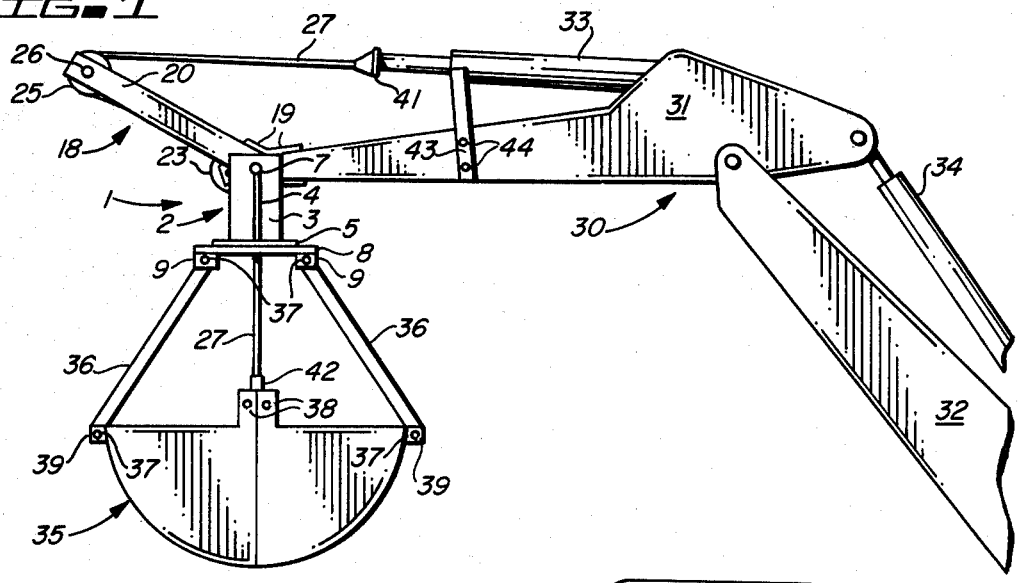
FIG. 2
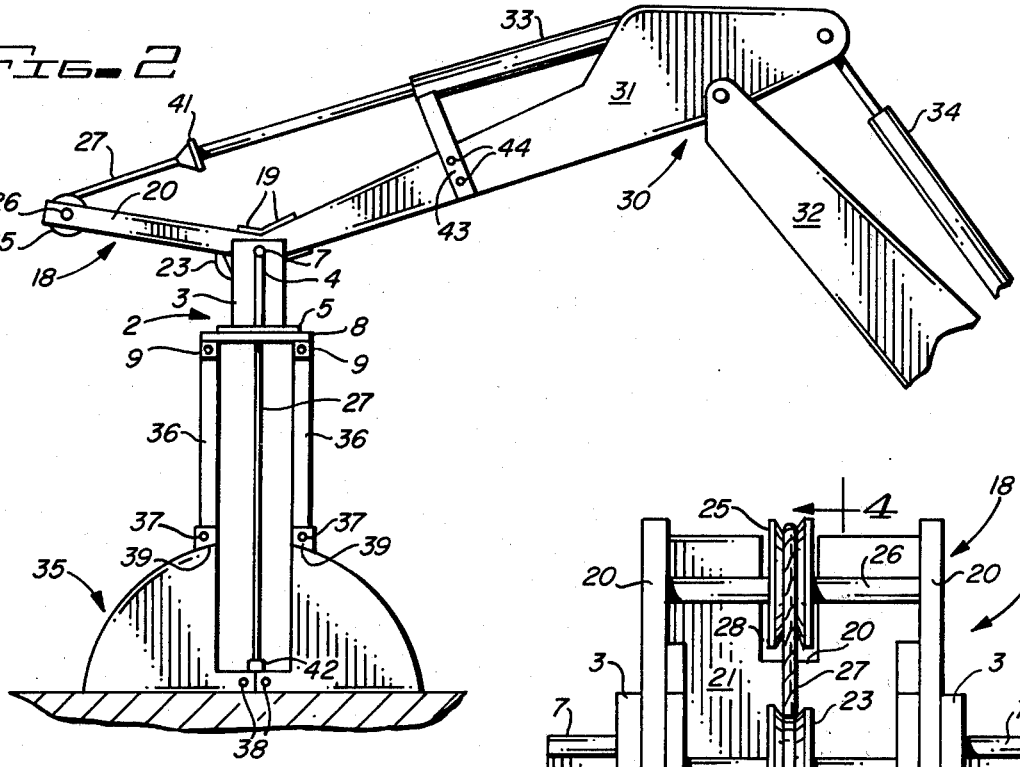
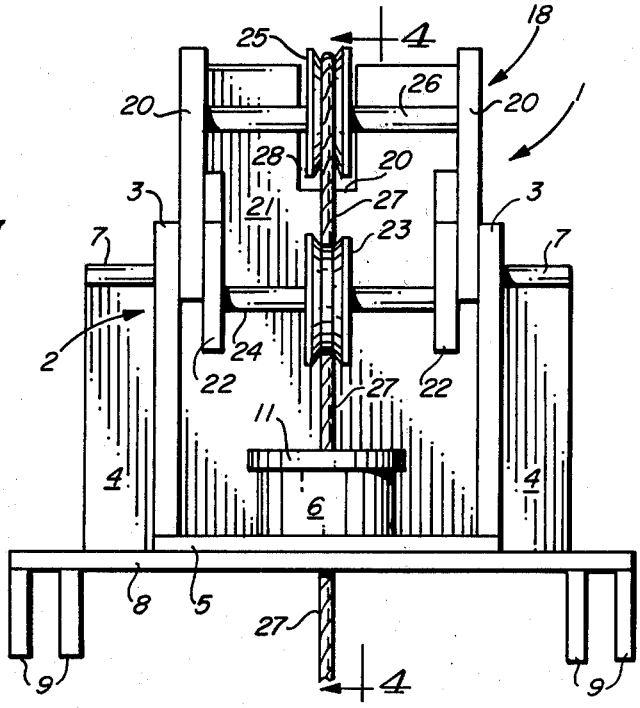
FIG. 3

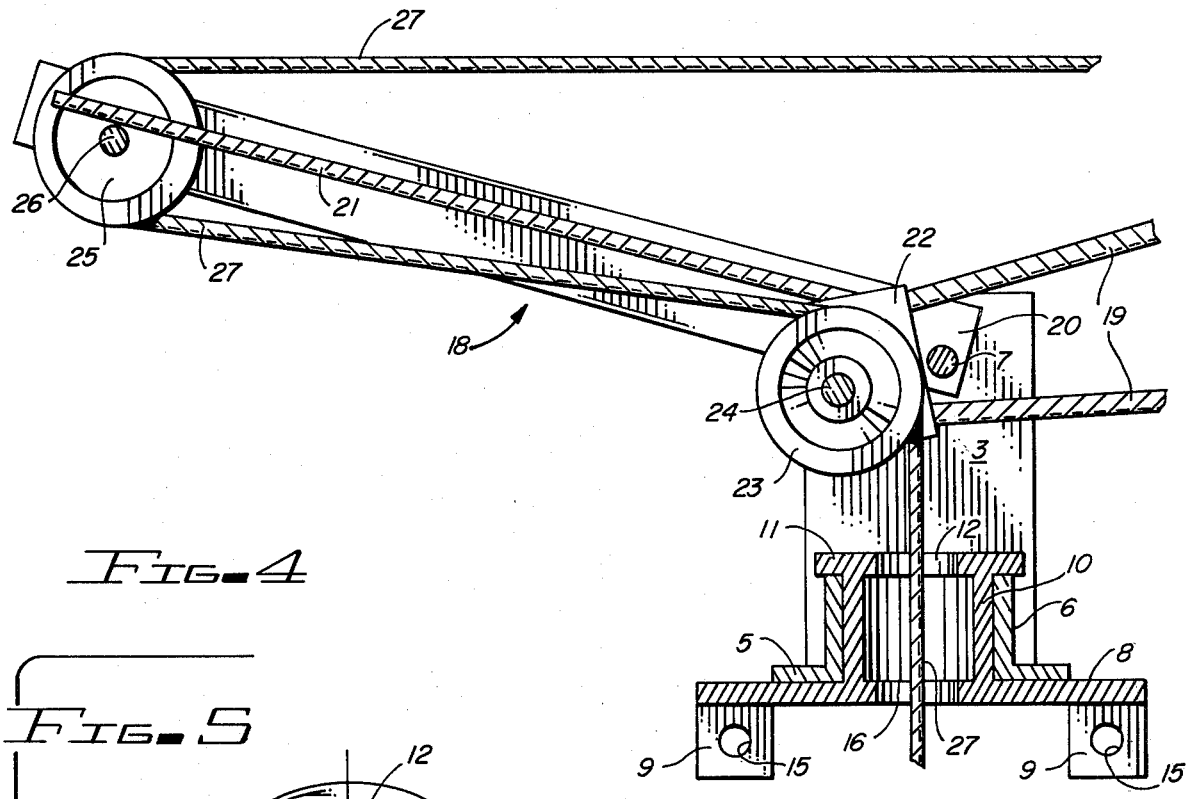
FIG. 4
FIG. 5
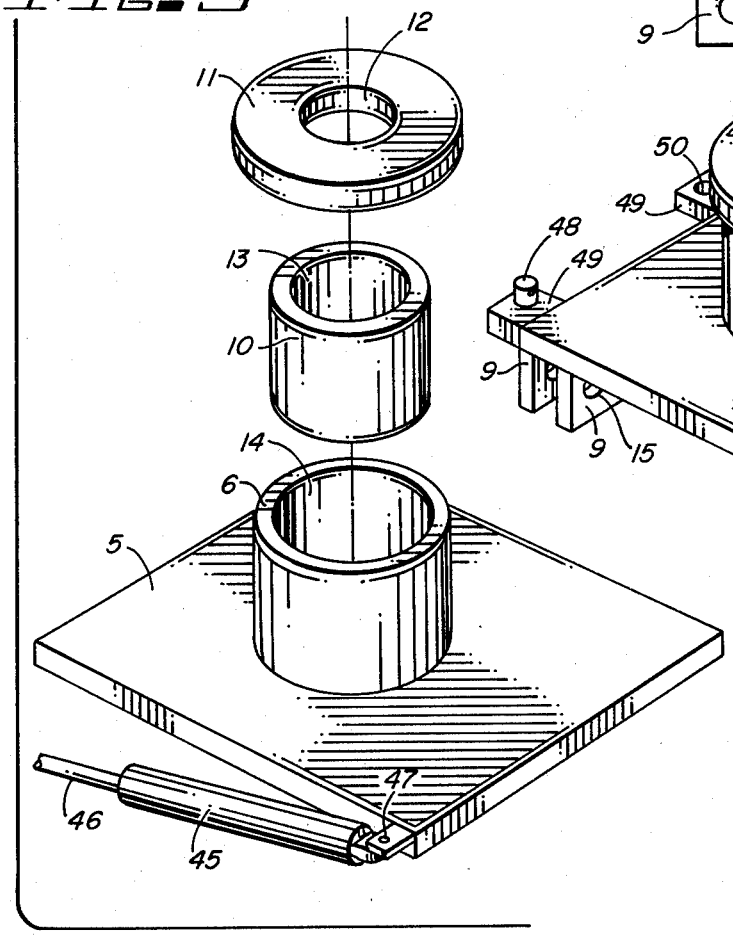
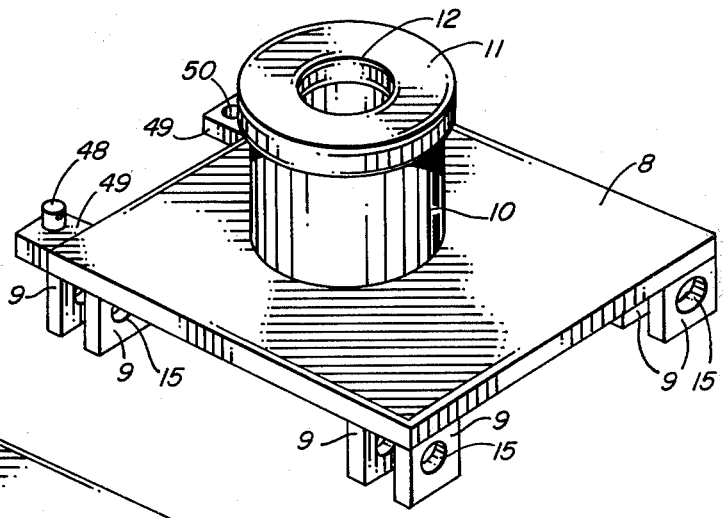
FIG. 6

CLAM BUCKET ATTACHMENT

BACKGROUND OF THE INVENTION

1. Field of the Invention

This invention relates to excavating equipment and more particularly, to a clam bucket attachment for removable cooperation with the crowd and crowd hydraulic cylinder of a conventional backhoe to dig ditches and effect other excavation in the construction industry. The clam bucket attachment of this invention can be adapted to substantially any commercially available hydraulic backhoe, and uses the bucket curl or crowd hydraulic cylinder to open and close a clam bucket which is suspended on one end of a wire cable threaded on a pair of rotatable sheaves which are positioned in the cable boom of the attachment apparatus. The clam bucket attachment is designed to permit the suspended clam bucket to pivot with respect to the backhoe crowd and also to rotate in as much as a 360° circle with respect to the crowd. Alternatively, the rotating function of the clam bucket can be limited and controlled by a small hydraulic cylinder or a reversible electric motor in order to position the bucket in a precise location with respect to the backhoe. The clam bucket attachment is also provided with an outwardly extending cable boom which fits on the end of the crowd and is secured in position, along with a bucket support mechanism, by means of a single pivot pin to facilitate quick and easy installation and removal of the attachment on the crowd of substantially any backhoe.

2. Description of the Prior Art

Clam buckets which are operated by means of drag lines and derricks of varying description are well known in the prior art and have for years been used for such purposes as moving logs, excavation of channels, digging holes for foundations in the construction of buildings and dredging canals. These buckets are provided with hinged mandibles which are controlled by cables extending from the bucket through a system of sheaves in the derrick or crane apparatus and wound on drums which cooperate with the engine of the maachine. An operator controls the operation of the crane boom and drums to effect the desired work using the clam shell to scoop and transport several yards of earth in each digging and lifting sequence.

Similarly, backhoe devices are well known in the prior art and are used for a number of purposes, chief among which is the trenching or excavation for the purpose of laying pipelines, digging foundations and the like. Backhoes are typically provided with rubber tires or tracks, depending upon the specific use to be made of the machine, and are characterized by an extending boom and a crowd which is pivotally attached to the end of the boom, the crowd in turn having a digging bucket pivotally positioned on the end thereof. The boom and crowd are typically operated by hydraulic cylinders which are activated by an operator to effect the desired digging and movement of earth, which is scooped in the bucket. Some backhoes are also provided with a "front end loading" capacity in addition to the bucket device for additional capability in excavating and moving excavated material.

In some instances it is desirable to dig a trench or excavation without traversing the axis of the trench with the machine accomplishing the excavation. This is sometimes necessary due to the close proximity of the trench to an existing structure or forms, or in certain circumstances where it is simply more desirable to have the trenching or excavating equipment in nonalignment with the trench or area to be excavated itself. Under these circumstances it is impossible to use conventional backhoes and trenching devices because such machines depend upon alignment with the traverse of the trench to accomplish the intended purpose. In most instances, backhoes and ditching machines must be aligned with a trench to be constructed in order to dig the trench.

Accordingly, it is an object of this invention to provide a new and improved clam bucket attachment which is capable of cooperating with a conventional backhoe and a conventional clam bucket to effect trenching and excavation work without the necessity of aligning the backhoe with the traverse of the trench or excavation to be accomplished.

Another object of this invention is to provide a clam bucket attachment which can be quickly and easily attached to the crowd of substantially any backhoe and used to excavate from a point or points substantially perpendicular to the traverse line of the excavation to be accomplished.

A still further object of this invention is to provide a clam bucket attachment for backhoes which is capable of being quickly and easily attached to the crowd or curl hydraulic cylinder of the backhoe, and which utilizes a cable boom having two sheaves and a wire cable threaded around the sheaves and a bucket support mechanism to suspend a conventional clam bucket from the cable and bucket support mechanism and effect the desired excavation.

A still further object of the invention is to provide a clam bucket attachment for cooperation with the crowd or bucket curl hydraulic cylinder of a conventional backhoe, which attachment utilizes a wire cable for opening and closing a conventional clam bucket, and which facilitates rotation of the clam bucket in as much as a 360° circle without the necessity of using a hydraulic motor to effect such rotation.

Yet another object of this invention is to provide a new and improved clam bucket attachment for backhoe machines, which can be quickly and easily attached to the crowd of the backhoe by means of a single pin to facilitate pivotal and rotatable suspension of a conventional clam bucket from a boom attached to the backhoe crowd, and operation of the bucket by means of a cable having one end attached to the bucket curl or crowd hydraulic cylinder on the backhoe crowd, and the opposite end attached to the clam bucket to effect excavation by operation of the backhoe crowd and the crowd hydraulic cylinder.

Yet another object of this invention is to provide a clam bucket attachment for backhoes, which attachment includes a boom which is capable of being removably and rigidly attached to the crowd of the backhoe, and a bucket support which is pivotally carried by the backhoe crowd, which boom carries a pair of spaced and rotatable sheaves, around which are threaded a wire cable having one end attached to the crowd hydraulic cylinder of the backhoe, and the opposite end secured to a conventional clam bucket, which clam bucket is both pivotaly and rotatably suspended from the backhoe crowd by means of the boom and the bucket support, and is therefore capable of digging in close places along straight lines and angles and particularly without interference to existing building forms and structures when digging foundation footings.

SUMMARY OF THE INVENTION

These and other objects of the invention are provided in a clam bucket attachment for backhoes which includes a rigid boom capable of being removably attached to the crowd of a backhoe and carrying a pair of rotatable sheaves, and a cooperating bucket support which is pivotally attached to the backhoe crowd by a pin which supports both the boom and the bucket support, the bucket support further designed to permit rotatable movement of a conventional clam bucket attached to the bucket support and connected to one end of a wire cable which is threaded around the sheaves, the opposite end of which cable is attached to the crowd hydraulic cylinder of the backhoe crowd. Opening and closing of the clam bucket is achieved by retracting and extending the crowd hydraulic cylinder, and the elevation of the clam bucket is controlled by raising and lowering the crowd and backhoe boom in conventional fashion.

A BRIEF DESCRIPTION OF THE DRAWING

The invention will be better understood by reference to the accompanying drawings, wherein:

FIG. 1 is a side elevation of the clam bucket attachment of this invention in functional position on the crowd of a backhoe device, with a conventional clam bucket suspended in elevated configuration;

FIG. 2 is a side elevation of the clam bucket attachment illustrated in FIG. 1 with the clam bucket lowered in contact with the ground;

FIG. 3 is a front elevation of a preferred embodiment of the clam bucket attachment;

FIG. 4 is a sectional view, taken along lines 4—4 of the clam bucket attachment illustrated in FIG. 3;

FIG. 5 is an exploded view of certain parts of the bucket support of the clam bucket attachment, more particularly illustrating a preferred means of pivotally orienting the clam bucket; and FIG. 6 is a perspective view of yet another portion of the bucket support.

DESCRIPTION OF THE PREFERRED EMBODIMENTS

Referring now to FIG. 1 of the drawings, the clam bucket attachment of this invention is generally illustrated by reference numeral 1, and is shown in functional position removably mounted on the crowd 31 of a backhoe boom apparatus 30. For purposes of illustration, the conventional backhoe boom apparatus 30, which consists of the crowd 31 and the cooperating backhoe boom 32, to which crowd 31 is pivotally attached, is shown, along with the accompanying crowd hydraulic cylinder 33 and boom hydraulic cylinder 34, the functions of which will be hereinafter described. A bucket support is generally illustrated by reference numeral 2, and includes a pair of spaced pivot brackets 3, each of which is preferably fitted with a stiffening flange 4. Pivot brackets 3 are attached to a pivot bracket plate 5 at one end, and are suspended at the opposite end from crowd 31 by means of a pivot pin 7, which registers with an aperture (not illustrated) in crowd 31. Also fitted to the end of crowd 31 is a cable boom 18, which is defined by a pair of spaced boom flanges 20 and crowd flanges 19, the latter of which removably engage crowd 31, and support cable boom 18 rigidly on crowd 31. A front sheave 25 is rotatably positioned on boom flanges 20 by means of a front sheave pin 26, and a rear sheave 23 is similarly pivotally mounted in cooperation with cable boom 18 by means of a rear sheave pin 24, which is mounted in a rear sheave support 22, as is more particularly illustrated in FIG. 4 of the drawing. A spacer brace 43 supports crowd hydraulic cylinder 33 and is fastened to crowd 31 by means of spacer brace bolts 44, in order to maintain a constant spacing between crowd hydraulic cylinder 33 and crowd 31, and compensate for the length of extension of the hydraulic cylinder piston.

A conventional clam bucket, generally illustrated by reference numeral 35, is attached to bucket support plate brackets 9, provided with support plate bracket apertures 15, of bucket support plate 8 by means of clam bucket straps 36 and strap bolts 37. Clam bucket 35 is fitted with clam bucket hinges 18, and the opposite ends of clam bucket straps 36 are attached to clam bucket brackets 39 by means of additional strap bolts 37. One end of a cable 27 is fitted to clam bucket hinges 38 by means of a bucket cable clamp 42, and the cable extends upwardly through bucket support plate 8 and pivot bracket plate 5, between pivot brackets 3, and around rear sheave 23 and front sheave 25, to terminate at crowd cable clamp 41, which is secured to the piston of crowd hydraulic cylinder 33. Accordingly, manipulation of crowd hydraulic cylinder 33 permits clam bucket 35 to open and close by extension and retraction, respectively, of the piston in crowd hydraulic cylinder 33, as illustrated in FIGS. 1 and 2. Bucket support plate 8 is pivotally mounted to pivot bracket plate 5, and facilitates rotation of the clam bucket 35 with respect to pivot bracket plate 5, as hereinafter described.

Referring now to FIGS. 3–6, in a preferred embodiment of the invention the pivoting function of clam bucket 35 and bucket support plate 8 with respect to pivot bracket plate 5 is facilitated by means of a bucket support plate collar 10, secured to bucket support plate 8, and a cooperating support cap 11, fitted to the top of bucket support plate collar 10, as illustrated. Support plate collar 10 fits concentrically in bracket plate collar aperture 14 of bracket plate collar 6, which is secured to pivot bracket plate 5, positioned on top of and adjacent bucket support plate 8. Accordingly, since pivot brackets 3 are attached to pivot bracket plate 5, the bucket support plate collar 10, support cap 11, the bucket support plate 8 and clam bucket 35, carried by bucket support plate 8, are free to rotate with respect to bracket plate collar 6, pivot brackets 3 and pivot bracket plate 5. The weight of clam bucket 35 and excavated earth or other materials therefore rests on support cap 11. In a preferred embodiment of the invention, the rotation of clam bucket 35 with respect to pivot brackets 3 is limited by a double-action bucket support hydraulic cylinder 45, having the cylinder end attached to pivot bracket plate 5 by means of a pivot clamp 47, and the hydraulic cylinder piston 46 secured to a piston clamp 48, provided on one of two hydraulic cylinder brackets 49, having bracket apertures 50, which brackets are secured to bucket support plate 8, as illustrated in FIG. 6. Accordingly, operation of bucket support hydraulc cylinder 45 facilitates rotation of bucket support plate 8, bucket support plate collar 10, support cap 11 and clam bucket 35 to a desired degree in order to manipulate clam bucket 35 into a desired position for excavation. In a preferred embodiment of the invention this rotational capability of bucket support plate 8 extends from 0 to about 30 degrees. Additional rotation of bucket support plate 8 and clam bucket 35 over and above 30 degrees is possible by attaching the bucket support hydraulic cylinder 45 to selected points on pivot bracket plate 5 to change the arc of rotation of bucket support plate 8.

Referring now specifically to FIGS. 3 and 4 of the drawings, cable boom 18 is defined by a pair of boom flanges 20, which extend in parallel spaced relationship with a boom flange divider 21 spacing the boom flanges 20. A boom flange divider slot 28 serves to accommodate front sheave 25, and cable 27 extends from crowd cable clamp 41, over front sheave 25, rearwardly between boom flanges 20, back over rear sheave 23, and downwardly through support cap aperture 12 in support cap 11, support plate collar aperture 13 in bucket support plate collar 10, and bucket support plate aperture 16 in bucket support plate 8, to connect with bucket cable clamp 42. Rear sheave 23 is rotatably mounted on rear sheave pn 24, and front sheave 25 is likewise rotatably mounted on front sheave pin 26 in order to permit cable 27 to easily traverse front sheave 25 and rear sheave 23, responsive to the extension and retraction of the piston in crowd hydraulic cylinder 33. As heretofore described, this action facilitates opening and closing of clam bucket 35 in order to permit the desired excavation.

It will be appreciated from a consideration of the drawings, and FIGS. 3 and 4 in particular, that pivot pin 7 extends through pivot brackets 3 and boom flanges 20, and finally, through apertures (not illustrated) in crowd 31 to pivotally support the bucket support 2 and permit clam bucket 35 to swing about this pivot axis and suspend vertically from crowd 31, regardless of the relative position of crowd 31. Accordingly, referring to FIGS. 1 and 2, clam bucket 35 is always in essentially perpendicular configuration with respect to the ground, both when suspended as illustrated in FIG. 1, and when in open contact with the ground, as illustrated in FIG. 2. This vertical orientation of clam bucket 35 is necessary in order to permit downward pressure to be applied to the clam bucket, as illustrated in FIG. 2, to aid in the excavation operation, as well as in moving and unloading clam bucket 35. This positioning of pivot pin 7 also serves to securely and rigidly, but removably mount cable boom 18 on crowd 31.

In operation, the conventional backhoe bucket is removed by removing the supporting pin or pins, and clam bucket attachment 1 is initially fitted to the end of the crowd 31 of a backhoe boom apparatus 30. A pivot pin 7 is aligned with the apertures in pivot brackets 3, boom flanges 20 and in crowd 31 to suspend clam bucket 35 and clam bucket attachment 1 from crowd 31. The backhoe is then manipulated into the desired position for excavation, and the boom hydraulic cylinder 34, which is attached to crowd 31 and to backhoe boom 32, is manipulated to extend the hydraulic cylinder piston and position the clam bucket 35 in the configuration illustrated in FIG. 2. Downward pressure is then applied to clam bucket 35 by means of boom hydraulic cylinder 34, and the piston of crowd hydraulic cylinder 33 is retracted to facilitate scooping of earth by clam bucket 35. When clam bucket 35 is closed and contains a load of earth, it is lifted and moved in conventional fashion by manipulation of crowd 31 and backhoe boom 32 to deposit the earth at another location or in a truck, as desired. The process is repeated as necessary in order to excavate according to given specifications.

The clam bucket attachment of this invention is characterized by great convenience and utility, in that it may be used in cooperation with substantially any clam bucket, and any backhoe which is provided with a crowd having an aperture in the end to receive the supporting pivot pin 7. The attachment is designed for use with backhoes which are provided with tires as well as tracks for locomotion, and a conventional clam bucket 35 of appropriate size and design can be utilized with these machines, depending upon the extent of excavation or lifting desired.

It will be appreciated by those skilled in the art that the support cap aperture 12 in support cap 11, the support plate collar aperture 14 in pivot bracket plate collar 6, and the bucket support plate aperture 16 in bucket support plate 8 can be adjusted, depending upon the size of the clam bucket 35 and the size of the clam bucket attachment 1 necessary to support the clam bucket 35. Since cable 27 moves inside plate collar aperture 14, support cap aperture 12 and bucket support plate aperture 16, it is highly desirable to provide sufficient room to prevent the cable from scraping the support cap 11 or bucket support plate 8, in order to minimize wear in the cable 27.

It will be further appreciated by those skilled in the art that several methods of construction of clam bucket attachment 1 are possible, particularly with respect to the pivot bracket plate collar 6, support plate collar 10, support cap 11, pivot bracket plate 5 and bracket support plate 8. Accordingly, in a preferred embodiment of the invention, bracket plate collar 6 is attached to pivot bracket plate 5 by either welding or, in a most preferred embodiment, by casting the two members in a single unit, and support plate collar 10 is attached to bucket support plate 8 in a similar manner. To assemble the bucket support 2, bucket support plate 8 is fitted beneath pivot bracket plate 5 with bucket support plate collar 10 concentrically inside bracket plate collar 6, and support cap 11 is welded or otherwise securely attached to bucket support plate collar 10.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A clam bucket attachment for mounting on the crowd of a backhoe, comprising:

(a) A cable boom having a flange means at one end for attachment to the crowd, said cable boom extending from the end of the crowd;

(b) a front sheave rotatably carried by the free end of said cable boom and a rear sheave spaced from said front sheave and rotatably carried by said cable boom forward of said flange means;

(c) a bucket support carried by said cable boom and further comprising a pair of pivot brackets in spaced, generally parallel relationship extending from said cable boom; a pivot bracket plate connecting said pivot brackets; a first collar upward standing from said pivot bracket plate between said pivot brackets; a bucket support plate beneath and adjacent said pivot bracket plate for carrying a clam bucket; a second collar attached to said bucket support plate and extending upwardly and concentrically through said first collar; and a support cap secured to the top of said second collar above said first collar, whereby said bucket support plate and said second collar are rotatable with respect to said pivot bracket plate and said first collar, and the clam bucket is rotatable with respect to said cable boom; and (d) a cable having one end secured to the piston of a hydraulic cylinder attached to the crowd of the backhoe, said cable wound around said front sheave and said rear sheave and through said support cap, said first and second collar and said bucket support plate, and the opposite end of said cable secured to the clam bucket, whereby extension and retraction of the hydraulic cylinder opens and closes the clam bucket, respectively.

2. The clam bucket attachment of claim 1 further comprising a spacer brace connecting the hydraulic cylinder and the crowd of the backhoe to maintain a constant spacing between the hydraulic cylinder and the crowd.

3. The clam bucket attachment of claim 1 wherein said flange means is a top flange bracket and a bottom flange bracket extending from said one end of said cable boom in spaced relationship.

4. The clam bucket attachment of claim 1 wherein said flange means is a top flange bracket and a bottom flange bracket extending from said one end of said cable boom in spaced relationship, and further comprising a spacer bore connecting the hydraulic cylinder and the crowd of the backhoe to maintain a constant spacing between the hydraulic cylinder and the crowd.

5. The clam bucket attachment of claim 1 further comprising a pivot pin extending through said pivot brackets, said cable boom and the crowd of the backhoe to secure said cable boom and said bucket support on the crowd.

6. The clam bucket attachment of claim 1 wherein said flange means is a top flange bracket and a bottom flange bracket extending from said one end of said cable boom in spaced relationship, and further comprising:

(a) a spacer brace connecting the hydraulic cylinder and the crowd of the backhoe to maintain a constant spacing between the hydraulic cylinder and the crowd; and (b) a pivot pin extending through said pivot brackets, said cable boom and the crowd of the backhoe to secure said cable boom and said bucket support on the crowd.

7. The clam bucket of claim 1 or claim 6 further comprising a bucket support hydraulic cylinder having a cylinder end attached to said pivot bracket plate, and a piston end attached to said bucket support plate for pivoting said bucket support plate and the clam bucket with respect to said pivot bracket plate and said pivot brackets.

8. The clam bucket of claim 1 or claim 7 wherein said cable boom further comprises a pair of boom flanges spaced by a divider having a slot at the extending end to receive said front sheave.

* * * * *